10/9/84 XR 4,476,394

United States Patent [19]

Müller et al.

[11] Patent Number: 4,476,394

[45] Date of Patent: Oct. 9, 1984

[54] INSERTION CANISTER FOR RADIOACTIVE MATERIAL TRANSPORTATION AND/OR STORAGE CONTAINERS

[75] Inventors: Erhard Müller, Gründau; Richard Christ, Bruchköbel; Hartmut Kroll, Hanau, all of Fed. Rep. of Germany

[73] Assignee: Transnuklear GmbH, Hanau, Fed. Rep. of Germany

[21] Appl. No.: 248,441

[22] Filed: Mar. 27, 1981

[30] Foreign Application Priority Data

Mar. 29, 1980 [DE] Fed. Rep. of Germany ..... 3013310

[51] Int. Cl.[3] ..... G21F 5/00

[52] U.S. Cl. ..... 250/507.1; 250/506.1

[58] Field of Search ..... 250/506.1, 515.1, 507.1, 250/518.1; 376/272

[56] References Cited

U.S. PATENT DOCUMENTS

| | | | |
|---|---|---|---|
| 3,016,463 | 1/1962 | Needham | 250/506 |
| 3,882,313 | 5/1975 | Siemens | 250/506 |
| 4,272,683 | 6/1981 | Baatz et al. | 250/506 |

*Primary Examiner*—Bruce C. Anderson

*Attorney, Agent, or Firm*—Cushman, Darby & Cushman

[57] ABSTRACT

Known containers for the transportation and/or storage of irradiated fuel elements have insertion canisters made of steel or massive bodies of non-ferrous metals. These have a high weight and possess no neutron shielding effect. These disadvantages are avoided by making an insertion canister consisting of graphite.

12 Claims, 5 Drawing Figures

INSERTION CANISTER FOR RADIOACTIVE MATERIAL TRANSPORTATION AND/OR STORAGE CONTAINERS

BACKGROUND OF THE INVENTION

The object of the present invention is a removable insertion canister located in a transportation and/or storage container; the canister having shafts for radioactive material, particularly for receiving spent fuel elements from nuclear reactors.

There is normally required an insertion canister in transportation and/or storage containers, in order to simultaneously dispose of several spent fuel elements from nuclear reactors during transportation or also during the storage to dispose them in predetermined distance from each other in a container. Therefore, the fuel elements positions corresponding necessary are constructed as correspondingly shafts into which the fuel elements are inserted. The cross-section of the shaft is adjusted in form and dimensions according to the type of fuel element inserted. Besides the fuel elements must be able to be inserted and removed without trouble by remote control. The insertion canister must be sufficiently stable in order that it can withstand the mechanical and thermal loadings during transportation. Besides it must be so constructed that the fuel elements transported are not damaged during the transportation and handling.

Such insertion canisters are normally constructed as pure steel frameworks or as massive blocks of non-ferrous metal. The shafts of the massive blocks are produced by machines. In a given case they are steel-clad.

Steel frameworks are suited as insertion canisters if a corresponding liquid is located in the transportation and/or storage container and which leads off the residual heat produced on the container wall by the fuel elements. The steel framework can consist of boron steel in which boron serves as a neutron absorber.

The massive non-ferrous metal constructions provided with shafts are suited as insertion canister since they make possible the drawing off of the residual heat produced without a helping medium on the container wall. They preferably consist of aluminum or copper or their alloys. These alloys in a given case can have added thereto boron or cadmium as neutron absorbers.

The previously known insertion canisters have a series of disadvantages. They have a high weight since they are constructed predominantly of metal because of the thermal conductivity required. Partially, particularly with special steel frameworks, there is necessary a disadvantageous water cooling in case of accident. The neutron shielding only takes place to a slight extent through the canister, the chief shielding effect is guaranteed through a separate neutron protection on the shielding transportation or stroage container. In the case of accidents, e.g. also fire, this neutron protection on the shielding container however, is destroyed.

Therefore it was the problem of the present invention to provide a removable insertion canister located in a transportation and/or storage container, the canister having shafts for radioactive material, especially for receiving spent fuel elements from nuclear reactors, which have a low weight, an effective neutron shielding and sufficient heat conductivity as well as being usable as an independent intermediate or final storage container.

SUMMARY OF THE INVENTION

The problem has been solved according to the invention by having the matrix of the insertion canister consist predominantly of graphite. The matrix can consist predominantly of, consist essentially of or consist of the stated materials.

BRIEF DESCRIPTION OF THE DRAWINGS

The invention is illustrated schematically in the drawings wherein.

DETAILED DESCRIPTION

Figure 1:
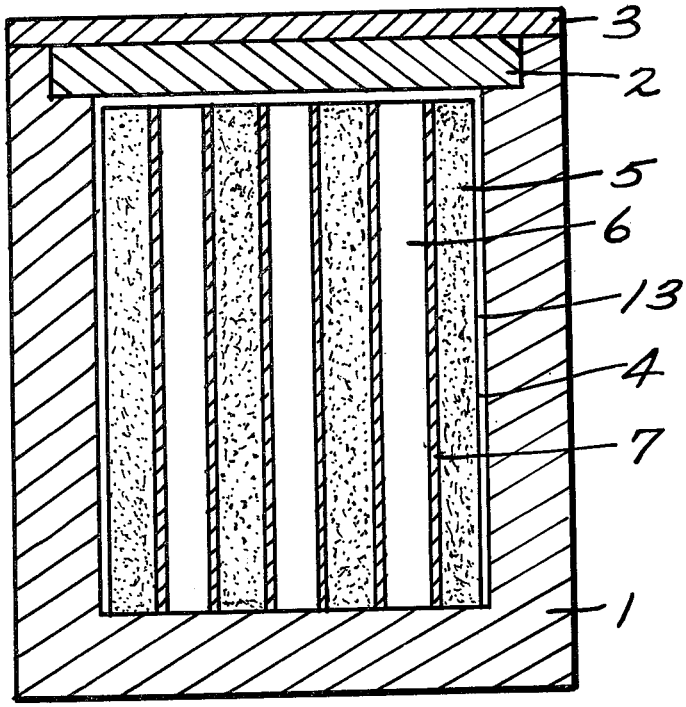
FIG. 1 as a side view of the insertion canister of the invention.
Figure 2:
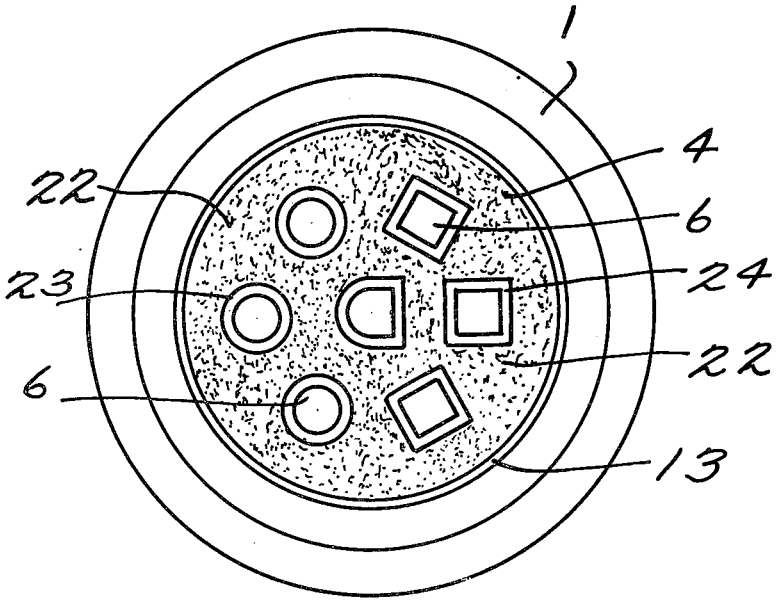
FIG. 2 is a corresponding plan view.
Figure 3:
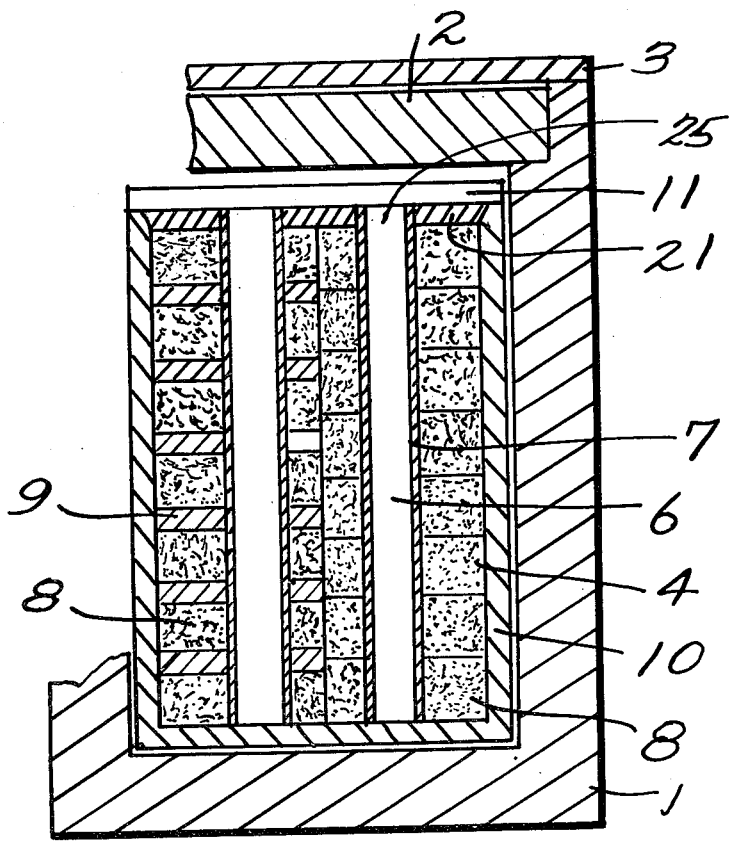
FIG. 3 shows construction of the insertion canister out of bricks with or without metal disks.
Figure 4:
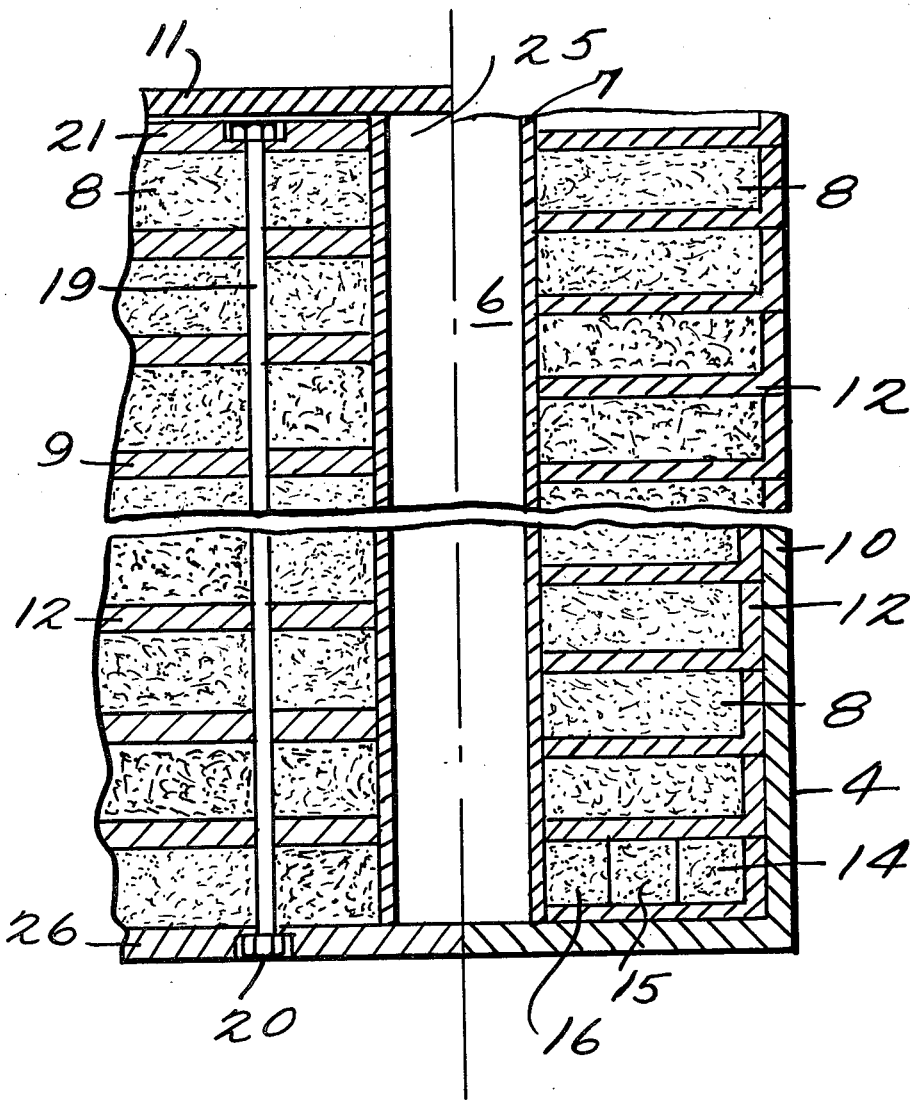
FIG. 4 shows the cup shaped configuration of the metal disks as well as a tension rod arrangement.
Figure 5:
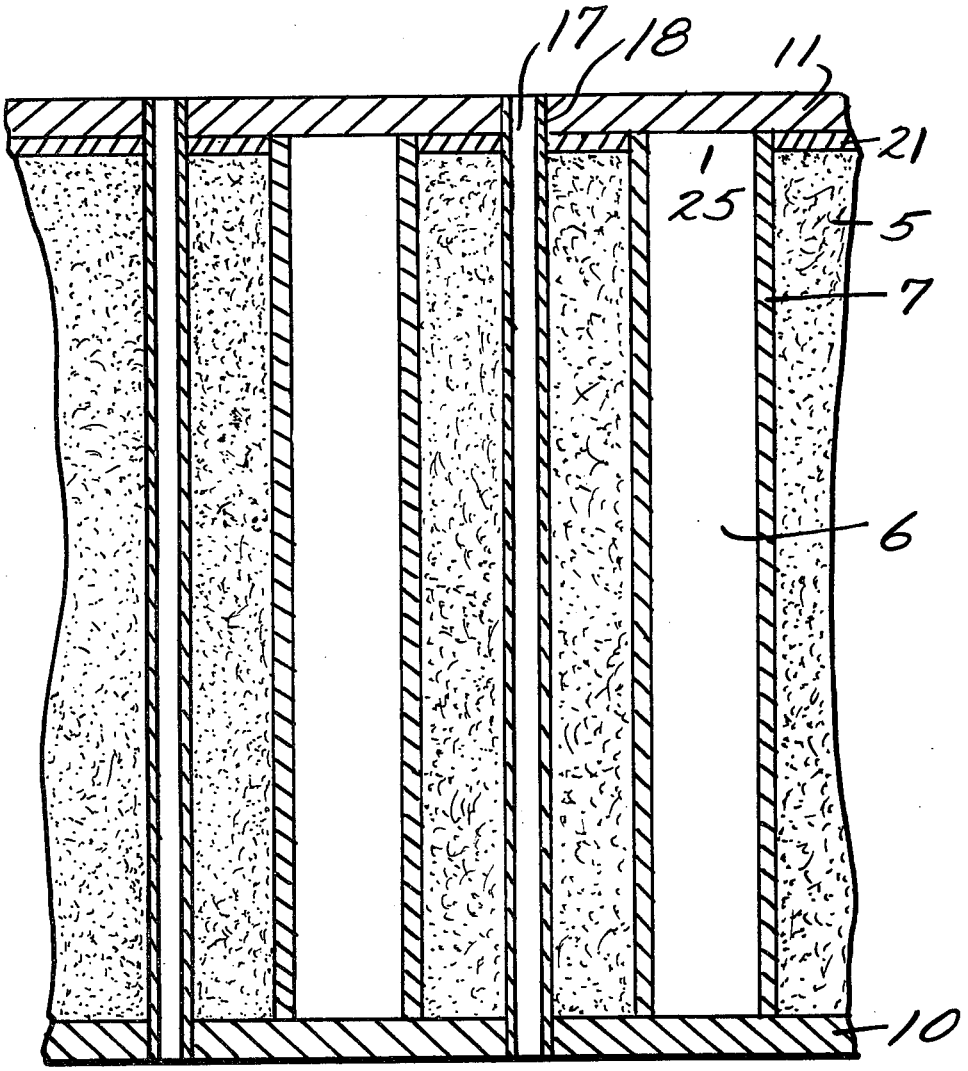
FIG. 5 shows cooling channels in the insertion canister.

Referring more specifically to the drawings there is contained in a shielding container 1, having a shielding cover 2 and an outer cover 3, a removable insertion canister 4, and the shafts 6 for receiving radio-active material, especially for receiving spent fuel elements. The matrix 5 of the insertion canister 4 consists of graphite, a light material which under normal conditions is difficult to burn and which has good heat conducting properties and outstanding neutron moderation qualities. The graphite of the graphite matrix 5 is preferably compressed, for example, by pressing or other known processes, and subsequently worked up, in a given case by wires, millings, and tubes. Thereby it has proven especially advantageous that the shafts 6 and/or the outer surface of the insertion canister 4 have metallic neutron absorbing coverings 7. These coverings can be tubes having a corresponding cross-section profile 23 and 24, or a canister like container 10 which is provided with a cover 21. The cover 21 contains openings 25 through which the radioactive material can be introduced into the shafts 6. The insertion canister 4 of the invention is closed by a cover 11. The use of boron steel as covering 7 for the shaft 6, the canister container 10 and the cover 27 is especially favorable, as is the mixing of boron carbide into the matrix graphite 5. Through this the n-capture is improved and the critical safety enlarged. Advantageously the graphite matrix 5 is constructed from correspondingly shaped bricks (8, 14, 15, 16, and 22), whereby a disk shaped brick 8 has proven especially favorable.

For the stabilization and for further improvement of the heat conductivity it is particularly advantageous to arrange metal disks 9 between the graphite disks 8. Thereby the metal disks 9 can likewise be prepared from neutron absorbing material. A particularly advantageous modification is the configuration of the metal disks 9 as a cup shape 12 in which the graphitic bricks 8, 14, 15, 16, and 22 are protected on all sides.

In special cases, the canister container 10 is eliminated. Then the insertion canister 4 consists of firm base plate 26 to which are secured the coverings 7 for the shafts 6, e.g., as welded or screwed on tubes, made of graphite bricks (8, 14, 15, 16, and 22) and of metal disks, all joined together by tension rods 19 and fastening elements 20.

The insertion canister 4 of the invention is outstandingly suitable to be used alone as storage canister in intermediate and final storage for storing radioactive materials. In this case, it is especially advantageous to lead cooling channels 17, preferably covered with neutron absorbing metal tubes, through the graphite mixture. If the insertion canister 4 is placed on a corresponding under structure in an air cooled intermediate storehouse then the cooling air flows through the cooling channels 17 because of the developing heat and draws off the waste heat arising through the radioactive decay.

The insertion canister 4 in a given case has devices on the tension rods 19, on the canister container 10 and on the canister cover 11 such as hooks or lugs for manipulation by means of cranes or similar lifting apparatuses.

In a given case the gap 13 between the canister 4 of the invention and the shielding container 1 can be filled with graphite or metal powder, likewise the remaining residual volume in the shafts 6 occupied by the radioactive fuel elements.

The insertion canister 4 of the invention furthermore has the advantage that it is erected quickly, e.g. by threading perforated graphite disks 8 and metal disks 9 to the coating tubes 23 and 24 of the shafts 6 or even to the tubes 18 of the cooling channels 17 and in a given case to the tension rods 20.

Furthermore, the described development of the insertion canister 4 either with the canister container 10 or with the metal disks 9 formed in the shape of a cup 12 also ensures in case of accident, that no graphite matrix material is lost.

There can be used for the graphite matrix 5 cheap graphite containing impurities. The content of impurities even improves the neutron absorbing properties of the insertion canister.

The entire disclosure of German priority application P 3012310.5-33 is hereby incorporated by reference.

What is claimed is:

1. A transportation or storage container having located therein a removable insertion canister, said canister having shafts therein adapted to receive radioactive material, especially for receiving spent fuel elements from nuclear reactors, said canister having a matrix made predominantly of graphite for modulating neutrons emitted from radioactive material mixed with a neutron absorbing material, said neutron absorbing material being made of a plurality of bricks.

2. A container according to claim 1 wherein the shafts and/or the outer surfaces of the insertion canister have a neutron absorbing metallic coating.

3. A container according to claim 2 wherein the metal coating on the insertion canister consists essentially of boron steel.

4. A container according to claim 1 wherein the neutron absorbing material of the graphite matrix is boron carbide.

5. A container according to claim 1 wherein the bricks comprise disks.

6. A container according to claim 5 wherein there are located metal disks between the bricks.

7. A container according to claim 5 wherein the metal disks are constructed in the shape of cups.

8. A container according to claim 1 wherein the canister comprises a base plate having secured thereto metal cladding, graphite bricks and metal disks which are joined together by tension rods and securing means.

9. A container according to claim 8 wherein the graphite matrix contains cooling channels.

10. A container according to claim 1 wherein the graphite matrix contains cooling channels.

11. A container according to claim 10 wherein the cooling channels are provided with a metallic covering.

12. A container according to claim 9 wherein the cooling channels are provided with a metallic covering.

* * * * *